US012196061B2

(12) United States Patent
Haukelidsæter Eidesen et al.

(10) Patent No.: US 12,196,061 B2
(45) Date of Patent: Jan. 14, 2025

(54) SUBSEA TEMPLATE FOR INJECTING FLUID FOR LONG TERM STORAGE IN A SUBTERRANEAN VOID AND METHOD OF CONTROLLING A SUBSEA TEMPLATE

(71) Applicant: HORISONT ENERGI AS, Sandnes (NO)

(72) Inventors: Bjørgulf Haukelidsæter Eidesen, Stavanger (NO); Ståle Brattebø, Tananger (NO)

(73) Assignee: HORISONT ENERGI AS (NO)

( * ) Notice: Subject to any disclaimer, the term of this patent is extended or adjusted under 35 U.S.C. 154(b) by 0 days.

(21) Appl. No.: 18/280,041

(22) PCT Filed: Mar. 2, 2022

(86) PCT No.: PCT/EP2022/055217
§ 371 (c)(1),
(2) Date: Sep. 1, 2023

(87) PCT Pub. No.: WO2022/184751
PCT Pub. Date: Sep. 9, 2022

(65) Prior Publication Data

US 2024/0141757 A1 May 2, 2024

(30) Foreign Application Priority Data

Mar. 4, 2021 (EP) ..... 21160744

(51) Int. Cl.
*E21B 41/00* (2006.01)
*E21B 41/08* (2006.01)

(52) U.S. Cl.
CPC ..... *E21B 41/0064* (2013.01); *E21B 41/08* (2013.01)

(58) Field of Classification Search
CPC ..... E21B 41/0064; E21B 41/08
(Continued)

(56) References Cited

U.S. PATENT DOCUMENTS 4,192,383 A * 3/1980 Kirkland ..... E21B 43/017 166/341
4,273,472 A * 6/1981 Piazza ..... E21B 33/037 166/356

(Continued)

FOREIGN PATENT DOCUMENTS

AU 2011250747 A1 5/2012

OTHER PUBLICATIONS

Shi, Ji-Quan et al., Snohvit CO2 storage project: Assessment of CO2 injection performance through history matching of the injection well pressure over a 32-months period, Energy Procedia 37 (2013) pp. 3267-3274.

(Continued)

*Primary Examiner* — Tara Schimpf
*Assistant Examiner* — Patrick F Lambe
(74) *Attorney, Agent, or Firm* — Dilworth IP, LLC

(57) ABSTRACT

A subsea template is aimed at injecting fluid, e.g. carbon dioxide, for long term storage in a subterranean void. The subsea template has a base structure with a set of module receiving sections, each of which is configured to receive a respective utility module. A pipe interface receives at least one conduit transporting the fluid, for example from a vessel. The pipe interface forwards the fluid for injection into the subterranean void through a drill hole under the base structure via a valve tree installed in one of the module receiving sections. The other utility modules are configured to support the injection of the fluid into the subterranean void.

19 Claims, 3 Drawing Sheets

(58) Field of Classification Search
USPC ..... 166/341
See application file for complete search history.

(56) References Cited

U.S. PATENT DOCUMENTS

| | | | | |
|---|---|---|---|---|
| 4,625,805 | A * | 12/1986 | Ladecky | E21B 41/08 166/341 |
| 4,919,210 | A * | 4/1990 | Schaefer, Jr. | E21B 33/037 405/226 |
| 5,025,865 | A | 6/1991 | Caldwell et al. | |
| 5,176,471 | A * | 1/1993 | Frafjord | E21B 41/08 166/356 |
| 5,192,167 | A * | 3/1993 | da Silva | E21B 43/017 166/341 |
| 5,526,882 | A * | 6/1996 | Parks | E21B 43/017 405/203 |
| 8,096,934 | B2 | 1/2012 | Koide et al. | |
| 2011/0303417 | A1 | 12/2011 | Mogedal | |
| 2012/0000665 | A1* | 1/2012 | Omvik | E21B 41/08 166/351 |
| 2015/0300530 | A1* | 10/2015 | Hunter | E21B 41/0007 29/428 |
| 2018/0003008 | A1* | 1/2018 | Osen | E21B 41/08 |
| 2019/0040706 | A1* | 2/2019 | Roberts-Haritonov | B63C 11/52 |
| 2019/0323325 | A1 | 10/2019 | Hestetun et al. | |
| 2019/0368326 | A1 | 12/2019 | Drescher et al. | |
| 2020/0102813 | A1 | 4/2020 | Greig et al. | |
| 2021/0047875 | A1 | 2/2021 | Haneferd et al. | |

OTHER PUBLICATIONS

Eiken, O et al., Lessons Learned from 14 years of CCS Operations: Sleipner, In Salah and Snohvit, Energy Procedia 4 (2011) pp. 5541-5548.

Haugen, H et al., Commercial capture and transport of CO2 from production of ammonia, Energy Procedia 114 (2017), pp. 6133-6140.

Hansen, Olav et al., Snohvit: The history of injecting and storing 1 Mt CO2 in the fluvial Tubaen Fm., SciVerse ScienceDirect, Elsevier, 2013, pp. 3565-3573.

European Search Report in EP Patent Application No. 21160744.5 dated Aug. 4, 2021.

Norwegian Search Report in NO Patent Application No. 20210289 dated Sep. 24, 2021.

International Search Report in International Patent Application No. PCT/EP2022/055217 dated Apr. 21, 2022.

* cited by examiner

SUBSEA TEMPLATE FOR INJECTING FLUID FOR LONG TERM STORAGE IN A SUBTERRANEAN VOID AND METHOD OF CONTROLLING A SUBSEA TEMPLATE

TECHNICAL FIELD

The present invention relates generally to strategies for reducing the amount of environmentally unfriendly gaseous components in the atmosphere. Especially, the invention relates to a subsea template for injecting fluid for long term storage in a subterranean void.

BACKGROUND

Carbon dioxide is an important heat-trapping gas, a so-called greenhouse gas, which is released through certain human activities such as deforestation and burning fossil fuels. However, also natural processes, such as respiration and volcanic eruptions generate carbon dioxide.

Today's rapidly increasing concentration of carbon dioxide, $CO_2$, in the Earth's atmosphere is problem that cannot be ignored. Over the last 20 years, the average concentration of carbon dioxide in the atmosphere has increased by 11 percent; and since the beginning of the Industrial Age, the increase is 47 percent. This is more than what had happened naturally over a 20000 year period—from the Last Glacial Maximum to 1850.

Various technologies exist to reduce the amount of carbon dioxide produced by human activities, such as renewable energy production. There are also technical solutions for capturing carbon dioxide from the atmosphere and storing it on a long term/permanent basis in subterranean reservoirs.

For practical reasons, most of these reservoirs are located under mainland areas, for example in the U.S.A and in Algeria, where the In Salah CCS (carbon dioxide capture and storage system) was located. However, there are also a few examples of offshore injection sites, represented by the Sleipner and Snøhvit sites in the North Sea. At the Sleipner site, $CO_2$ is injected from a bottom fixed platform. At the Snøhvit site, $CO_2$ from LNG (Liquefied natural gas) production is transported through a 153 km long 8 inch pipeline on the seabed and is injected from a subsea template into the subsurface below a water bearing reservoir zone as described inter alia in Shi, J-Q, et al., "Snøhvit $CO_2$ storage project: Assessment of $CO_2$ injection performance through history matching of the injection well pressure over a 32-months period", Energy Procedia 37 (2013) 3267-3274. The article, Eiken, O., et al., "Lessons Learned from 14 years of CCS Operations: Sleipner, In Salah and Snøhvit", Energy Procedia 4 (2011) 5541-5548 gives an overview of the experience gained from three $CO_2$ injection sites: Sleipner (14 years of injection), In Salah (6 years of injection) and Snøhvit (2 years of injection).

The Snøhvit site is characterized by having the utilities for the subsea $CO_2$ wells and template onshore. This means that for example the chemicals, the hydraulic fluid, the power source and all the controls and safety systems are located remote from the place where $CO_2$ is injected. This may be convenient in many ways. However, the utilities and power must be transported to the seabed location via long pipelines and high voltage power cables respectively. The communications for the control and safety systems are provided through a fiber-optic cable. The $CO_2$ gas is pressurized onshore and transported through a pipeline directly to a well head in a subsea template on the seabed, and then fed further down the well into the reservoir. This renders the system design highly inflexible because it is very costly to relocate the injection point should the original site fail for some reason. In fact, this is what happened at the Snøhvit site, where there was an unexpected pressure build up, and a new well had to be established.

As an alternative to the remote-control implemented in the Snøhvit project, the prior art teaches that $CO_2$ may be transported to an injection site via surface ships in the form of so-called type C vessels, which are semi refrigerated vessels. Type C vessels may also be used to transport liquid petroleum gas, ammonia, and other products.

In a type C vessel, the pressure varies from 5 to 18 Barg. Due to constraints in tank design, the tank volumes are generally smaller for the higher pressure levels. The tanks used have a cold temperature as low as −55 degrees Celsius. The smaller quantities of $CO_2$ typically being transported today are held at 15 to 18 Barg and −22 to −28 degrees Celsius. Larger volumes of $CO_2$ may be transported by ship under the conditions: 6 to 7 Barg and −50 degrees Celsius, which enables use of the largest type C vessels. See e.g. Haugen, H. A., et al., "13th International Conference on Greenhouse Gas Control Technologies, GHGT13, 14-18—November 2016, Lausanne, Switzerland Commercial capture and transport of $CO_2$ from production of ammonia", Energy Procedia 114 (2017) 6133-6140.

U.S. Pat. No. 8,096,934 shows a system for treating carbon dioxide, and a method by which such treated carbon dioxide can be stored underground at low cost and with high efficiency. The method includes: a step for pumping up to the ground groundwater from a pumping well in a deep aquifer, and then producing injection water. Carbon dioxide that has been separated and recovered from exhaust gas from a plant facility is changed into the bubbles. The bubbles are mixed with the injection water, and hereby produces a gas-liquid mixture a step for injecting into. The deep aquifer is injected into the gas-liquid mixture from the injection well. The method preferably farther includes a step for dissolving a cation-forming material in the injection water, and a step for injecting the injection water, in which the cation-forming material is dissolved, into the deep aquifer at its top and above the place at which injection water has already been injected.

U.S. 2019/0368326 discloses methods of enhanced oil recovery (EOR) from an oil reservoir by $CO_2$ flooding. One method involves producing a well stream from the reservoir; separating the well stream into a liquid phase and a gas phase with a first gas/liquid separator, wherein the gas phase contains both $CO_2$ gas and hydrocarbon gas; cooling the gas phase with a first cooler; compressing the gas phase using a first compressor into a compressed stream; mixing the compressed stream with an external source of $CO_2$ to form an injection stream; and injecting the injection stream into the reservoir. Systems for EOR from an oil reservoir by $CO_2$ flooding are also disclosed.

Thus, solutions are known for injecting environmentally unfriendly fluids like carbon dioxide into subterranean reservoirs. However, there is yet no injection solution that provides a flexible and cost-efficient seabed installation on top of the drill hole to the subterranean reservoir.

SUMMARY

The object of the present invention is therefore to offer a solution that solves the above problems.

According to one aspect of the invention, the object is achieved by a subsea template for injecting fluid for long term storage in a subterranean void. Preferably, the fluid contains at least 90 wt. % carbon dioxide. The subsea template contains: a base structure, a number of utility modules and a pipe interface. The base structure includes a set of module receiving sections each of which is configured to receive a respective utility module. The pipe interface is configured to receive at least one conduit that transports the fluid. The pipe interface is further configured forward the fluid for injection into the subterranean void via a drill hole under the base structure. The utility modules are installed on the base structure. Here, each of said utility modules is arranged in a respective one of the module receiving sections. The utility modules are configured to support the injection of the fluid into the subterranean void, for example by providing pressurized hydraulic fluid and/or anti-freeze chemicals.

This subsea template is advantageous because the modular design renders it straightforward to tailor the functionality to the specific needs of each injection site. Consequently, each site need only be equipped with the utility modules required at that site. This is beneficial from a cost perspective.

According to one embodiment of this aspect of the invention, the subsea template contains a power interface configured receive electric power for distribution to at least one unit in the subsea template. The electric power may be supplied via a cable from a power source in the form of low-power direct current. The power source may either be co-located with the offshore injection site, for instance as a wind turbine, a solar panel and/or a wave energy converter; and/or be positioned at an onshore site and/or at another offshore site geographically separated from the offshore injection site. Thus, the invention allows for flexibility and redundancy with respect to the energy supply for the subsea template.

According to another embodiment of this aspect of the invention, the utility modules contain: a hydraulic pressure tank configured to hold hydraulic fluid to be used by at least one unit in the subsea template, a hydraulic power unit (HPU) configured to pressurize the hydraulic fluid in the hydraulic pressure tank, an anti-freeze unit configured to store at least one anti-freeze chemical and cause the at least one anti-freeze chemical to be distributed to at least one unit in the subsea template, a pump unit configured to pump the received fluid into the subterranean void, and/or a battery configured to store electric power and cause the electric power to be distributed to at least one unit in the subsea template.

According to yet another embodiment of this aspect of the invention, each of the utility modules contains at least one interface panel configured to enable at least one connection between the utility module and at least one other utility module of said utility modules. Preferably, the subsea template also contains at least one cable channel interconnecting at least two module receiving sections in the set of module receiving sections. The cable channels are configured to provide exchange of pressurized hydraulic fluid, electric energy, commands and/or status signals between utility modules installed in the respective module receiving sections. The cable channels are installed in the base structure prior to installing the utility modules in the at least two module receiver sections. This renders building the subsea template straightforward. Various designs may therefore be implemented in a very time efficient manner.

According to still another embodiment of this aspect of the invention, at least one battery is comprised in at least one of the utility modules. Preferably, the power interface is configured to distribute the received electric power to the at least one battery. However, alternatively or in addition thereto, energy may be stored in the at least one battery by refilling it/them with electrolytes or ammonia. Of course, another option is to replace a discharged battery with a charged ditto. The at least one battery may include cells of lithium ion type, or units containing electrolytes or ammonia. Consequently, it can be ensured that electric energy is available at the subsea template.

According to a further embodiment of this aspect of the invention, at least one HPU is comprised in at least one of the utility module, and the power interface is configured to distribute the received electric power to the at least one hydraulic power unit. Naturally, alternatively or in addition thereto, the at least one HPU may be powered by the at least one battery. Hence, the at least one HPU may be used to operate various hydraulic equipment in the subsea template.

According to yet another embodiment of this aspect of the invention, the subsea template has a communication interface configured to: receive commands for controlling at least one unit in the subsea template, and transmit status signals indicating at least one condition of at least one unit in the subsea template. Thereby, the subsea template may be remote controlled, for example from an onshore site or a vessel.

According to another embodiment of this aspect of the invention, the base structure has an overall rectangular outline with four corners, and a respective corner module receiving section in the set of module receiving sections is located in each of the four corners of the overall rectangular outline. Preferably, each of the corner module receiver sections has at least one guide member configured to steer the corner utility modules towards a respective final position in the corner module receiving section when the corner utility module is lowered over the corner module receiver section. Analogously, each of the corner modules has at least one receiver member configured to engage the at least one guide member so as to cause the corner utility module to be steered towards the final position when the corner module is lowered. As a result, building the subsea template can be facilitated.

According to still another embodiment of this aspect of the invention, each of the corner utility modules has at least one shield surface arranged on an outer side of the corner utility module. The outer side faces away from an interior of the subsea template when the corner utility module is mounted in one of the corner module receiving sections on the base structure. The at least one shield surface is arranged at an acute angle, say 50 to 60 degrees, relative to an upper surface of the base structure. Namely, such an orientation reduces the risk that trawls or similar kinds of fishing equipment are entangled in the subsea template.

According to yet another embodiment of this aspect of the invention, at least one of the shield surfaces contains at least one opening to at least one lifting lug configured to enable a lifting hook to be attached for transporting the corner utility module.

The at least one lifting lug is recessed in the at least one opening to allow trawls to be dragged over the shield surface without risk being entangled in the at least one lifting lug.

According to another embodiment of this aspect of the invention, the base structure has an inner area between the corners of the overall rectangular outline, and at least one top cover element is arranged to close the inner area. The at least one top cover element is attached to a respective one of the corner utility modules via a respective pivot joint having its pivot axis perpendicular to the base structure. This provides efficient protection for the inner area. At the same time the inner area can be conveniently accessed when needed.

According to a further embodiment of this aspect of the invention, the subsea template includes at least one valve tree, which is configured to forward the received fluid to the drill hole. Further, the at least one valve tree is configured to be remote controllable in response to commands received via the communication interface. Thereby, a minimal number of onsite staffing is required on the vessel that offloads the fluid.

According to one embodiment of this aspect of the invention, the pipe interface is configured to receive the at least one conduit transporting the fluid from a fluid store located on a seabed, a pipeline from an onshore facility, and/or a surface ship, e.g. as a transport vessel. Hence, a wide range of fluid sources is enabled.

According to yet another embodiment of this aspect of the invention, only a single utility module is installed on the base structure. The single utility module contains a wellhead seal that is configured to keep the drill hole closed pending for potential future use of the subterranean void. The wellhead seal, in turn, may include a battery configured to provide power for a minimal set of equipment, such as an environmental monitoring device, and/or an actuator for opening and closing a valve element securing the well. Consequently, the subsea template can remain dormant until needed, at which point in time it may be activated in a straightforward manner.

According to a further embodiment of this aspect of the invention the subsea template contains a seismic monitoring system that is configured to detect movements in the seabed and/or the subterranean void, which movements result from seismic activity; and transmit status signals via the communication interface, which status signals indicate whether seismic activity has been detected. Consequently, early notifications of any oncoming earthquakes or seismic rumblings can be sent out to relevant recipients.

According to another aspect of the invention, the object is achieved by a method of operating the proposed subsea template, wherein the method involves controlling a remotely operated vehicle to carry out at least one task to support injection of fluid into the subterranean void via the subsea template. The remotely operated vehicle is stationed on a seabed at the subsea template, or on a vessel, for example carrying the fluid or a vessel forming a dedicated base for the remotely operated vehicle. The remotely operated vehicle is controlled in response to operator commands from a control site and/or the vessel. Thereby, the subsea template can be conveniently controlled without requiring onsite personnel.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DETAILED DESCRIPTION

Figure 1:
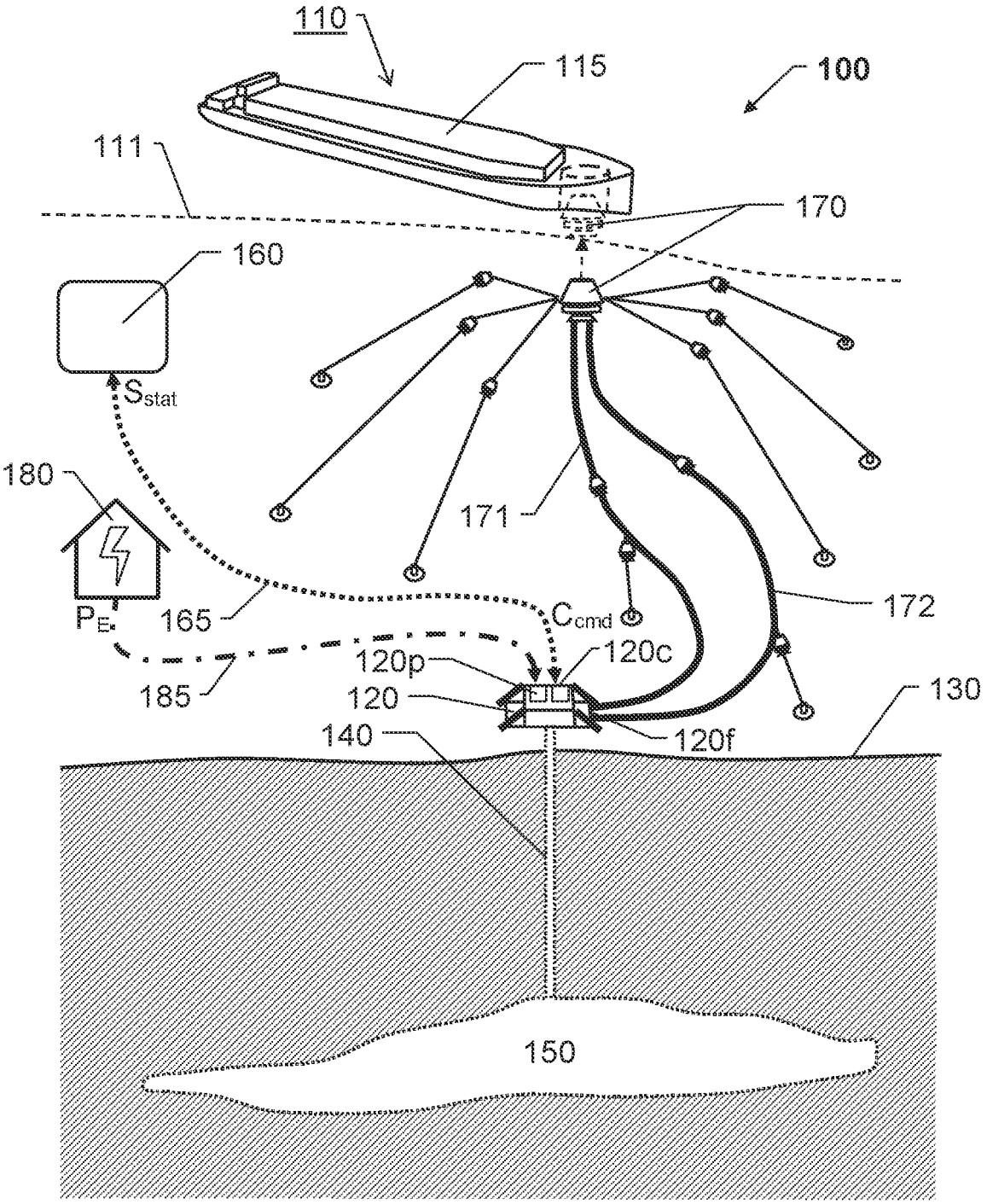
FIG. 1 schematically illustrates a system for long term storage of fluids in a subterranean void in which system the invention is comprised.

In FIG. 1, we see a schematic illustration of a system according to one embodiment of the invention for long term storage of fluids, e.g. containing at least 60 wt. % carbon dioxide, in a subterranean void, or accommodation space, 150, which typically is a subterranean aquifer. However, according to the invention, the subterranean void 150 may equally well be a reservoir containing gas and/or oil, a depleted gas and/or oil reservoir, a carbon dioxide storage/disposal reservoir, or a combination thereof. These subterranean accommodation spaces are typically located in porous or fractured rock formations, which for example may be sandstones, carbonates, or fractured shales, igneous or metamorphic rocks.

The system includes at least one offshore injection site 100, which is configured to receive fluid, e.g. in a liquid phase, from at least one fluid tank 115 of a vessel 110. The offshore injection site 100, in turn, contains a subsea template 120 arranged on a seabed/sea bottom 130. The subsea template 120 is located at a wellhead for a drill hole 140 to the subterranean void 150. The subsea template 120 also contains a utility system configured to cause the fluid from the vessel 110 to be injected into the subterranean void 150 in response to control commands $C_{cmd}$. In other words, the utility system is not located onshore, which is advantageous for logistic reasons. For example therefore, in contrast to the above-mentioned Snøhvit site, there is no need for any umbilicals or similar kinds of conduits to provide supplies to the utility system.

According to one embodiment of the invention, the subsea template 120 has at least one utility module that contains at least one storage tank. The at least one storage tank holds at least one assisting liquid, which is configured to facilitate at least one function associated with injecting the fluid into the subterranean void 150. The at least one assisting liquid contains a de-hydrating liquid and/or an anti-freezing liquid.

In particular, the at least one storage tank may hold MEG. The MEG may further be heated in the vessel 110, and be injected into the subterranean void 150 prior to injecting the fluid, for instance in the form of $CO_2$ in the liquid phase. Namely, the injection, e.g. of $CO_2$, vaporizes formation water which typically surrounds the subsea template 120 and its wellhead into the dry $CO_2$, especially near the injection wellbore. This increases formation water salinity locally, leading to supersaturation and subsequent salt precipitation. The process is aggravated by capillary and, in some cases, gravity backflow of brine into the dried zone. The accumulated precipitated salt reduces permeability around the injection well, and may cause unacceptably high injection pressures, and consequently reduced injection. The effect depends on formation water salinity and composition, and formation permeability. A MEG injection system of the subsea template 120 preferably contains a storage tank, an accumulator tank an at least one chemical pump.

The above is an issue particularly for an early injection period, before establishing a significant $CO_2$ plume around the injection well, when formation water backflow during injection stops it is more likely to occur.

In FIG. 1, a control site, generically identified as 160, is adapted to generate the control commands $C_{cmd}$ for controlling the flow of fluid from the vessel 110 and down into the subterranean void 150. The control site 160 is positioned at a location geographically separated from the offshore injection site 100, for example in a control room onshore. However, additionally or alternatively, the control site 160 may be positioned at an offshore location geographically separated from the offshore injection site, for example at another offshore injection site. Consequently, a single control site 160 can control multiple offshore injection sites 100. There is also large room for varying which control site 160 controls which offshore injection site 100. Communications and controls are thus located remote from the offshore injection site 100. However, as will be discussed below, the offshore injection site 100 may be powered locally, remotely or both.

The offshore injection site 100 may include a buoy-based off-loading unit 170, for instance of submerged turret loading (STL) type. When inactive, the buoy-based off-loading unit 170 may be submerged to 30-50 meters depth, and when the vessel 110 approaches the offshore injection site 100 to offload fluid, the buoy-based off-loading unit 170 and at least one injection riser 171 and 172 connected thereto are elevated to the water surface 111. After that the vessel 110 has been positioned over the buoy-based off-loading unit 170, this unit is configured to be connected to the vessel 110 and receive the fluid from the vessel's fluid tank(s) 115, for example via a swivel assembly in the vessel 110.

Each of the at least one injection riser 171 and 172 respectively is configured to forward the fluid from the buoy-based off-loading unit 170 to the subsea template 120, which, in turn, is configured to pass the fluid on via the wellhead and the drill hole 140 down to the subterranean void 150.

According to one embodiment of the invention, the subsea template 120 contains a power input interface 120*p*, which is implemented in at least one utility module and is configured to receive electric energy $P_E$ for operating the utility system. The power input interface 120*p* may be configured to receive the electric energy $P_E$ to be used in connection with operating a well at the wellhead, a safety barrier element of the subsea template 120 and/or a remotely operated vehicle (ROV). The ROV may be stationed on the seabed 130 at the subsea template 120. Alternatively, the ROV may be launched from the vessel 110, or from a dedicated ROV launching vessel servicing one or more subsea templates 120. If stationed on the seabed 130 at the subsea template 120, such an ROV may be powered by a remote power source as described below. If the ROV departs from another base, the ROV preferably receives its power from that base. In any case, it is beneficial if the ROV is remote controllable in response to commands from an operator located at a control site. Hence, the ROV may be connected via a communication cable, electric and/or optic, to a communication interface. The communication interface, in turn, may be connected to the control site directly, e.g. by means of a submerged cable, via the subsea template, or via the buoy-based off-loading unit 170 and a wireless link, e.g. implemented via a mobile communications network and/or a satellite link. Alternatively, or additionally, the ROV may be remote controllable in response to commands from an operator located on the vessel 110.

It is further preferable if the ROV is configured to monitor the injection site 100, especially the subsea template 120 and the surrounding seabed 130 between consecutive fluid injection occasions as well as after that injection of fluid into the subterranean void 150 has been completed and the drill hole 140 has been sealed. Thus, the ROV may for example detect fluid leakages. Preferably, during such monitoring tasks, the ROV is controlled and powered by one or more of the above-described control and power means.

FIG. 1 illustrates a generic power source 180, which is configured to supply the electric power $P_E$ to the power input interface 120*p*. It is generally advantageous if the electric power $P_E$ is supplied via a cable 185 from the power source 180 in the form of low-power direct current (DC) in the range of 200V-1000V, preferably around 400V. The power source 180 may either be co-located with the offshore injection site 100, for instance as a wind turbine, a solar panel and/or a wave energy converter; and/or be positioned at an onshore site and/or at another offshore site geographically separated from the offshore injection site 100. Thus, there is a good potential for flexibility and redundancy with respect to the energy supply for the offshore injection site 100.

The subsea template 120 may contain a valve system embodied in one or more utility modules as will be described below. The valve system is configured to control the injection of the fluid into the subterranean void 150. The valve system, as such, may be operated by hydraulic means, electric means or a combination thereof. The subsea template 120 preferably also includes at least one battery configured to store electric energy for use by the valve system as a backup to the electric energy $P_E$ received directly via the power input interface 120*p*. More precisely, if the valve system is hydraulically operated, the subsea template 120 contains an HPU configured to supply pressurized hydraulic fluid for operation of the valve system. For example, the HPU may supply the pressurized hydraulic fluid through a hydraulic small-bore piping system. The at least one battery is here configured to store electric backup energy for use by the hydraulic power unit and the valve system.

According to one embodiment of the invention, at least one battery is comprised in at least one of the utility modules. Preferably, the power interface is configured to distribute the received electric power to the at least one battery. However, alternatively or in addition thereto, energy may be stored in the at least one battery refilling it/them with electrolytes or ammonia. Namely, the at least one battery may be contain ammonia fueled fuel cell with a subsea ammonia tank, where the ammonia is passively kept in liquid state by the hydrostatic pressure. Thus, for example, an ROV may be controlled to "fly" down with a hose from the vessel 110 and refill ammonia in one or more of the batteries. Of course, an alternative to charge the battery is to replace a discharged battery with a charged ditto.

Alternatively, or additionally, the valve operations may also be operated using an electrical wiring system and electrically controlled valve actuators. In such a case, the subsea template 120 contains an electrical wiring system configured to operate the valve system by means of electrical control signals. Here, the at least one battery is configured to store electric backup energy for use by the electrical wiring system and the valve system.

Consequently, the valve system may be operated also if there is a temporary outage in the electric power supply to the offshore injection site. This, in turn, increases the overall reliability of the system.

Figure 2:
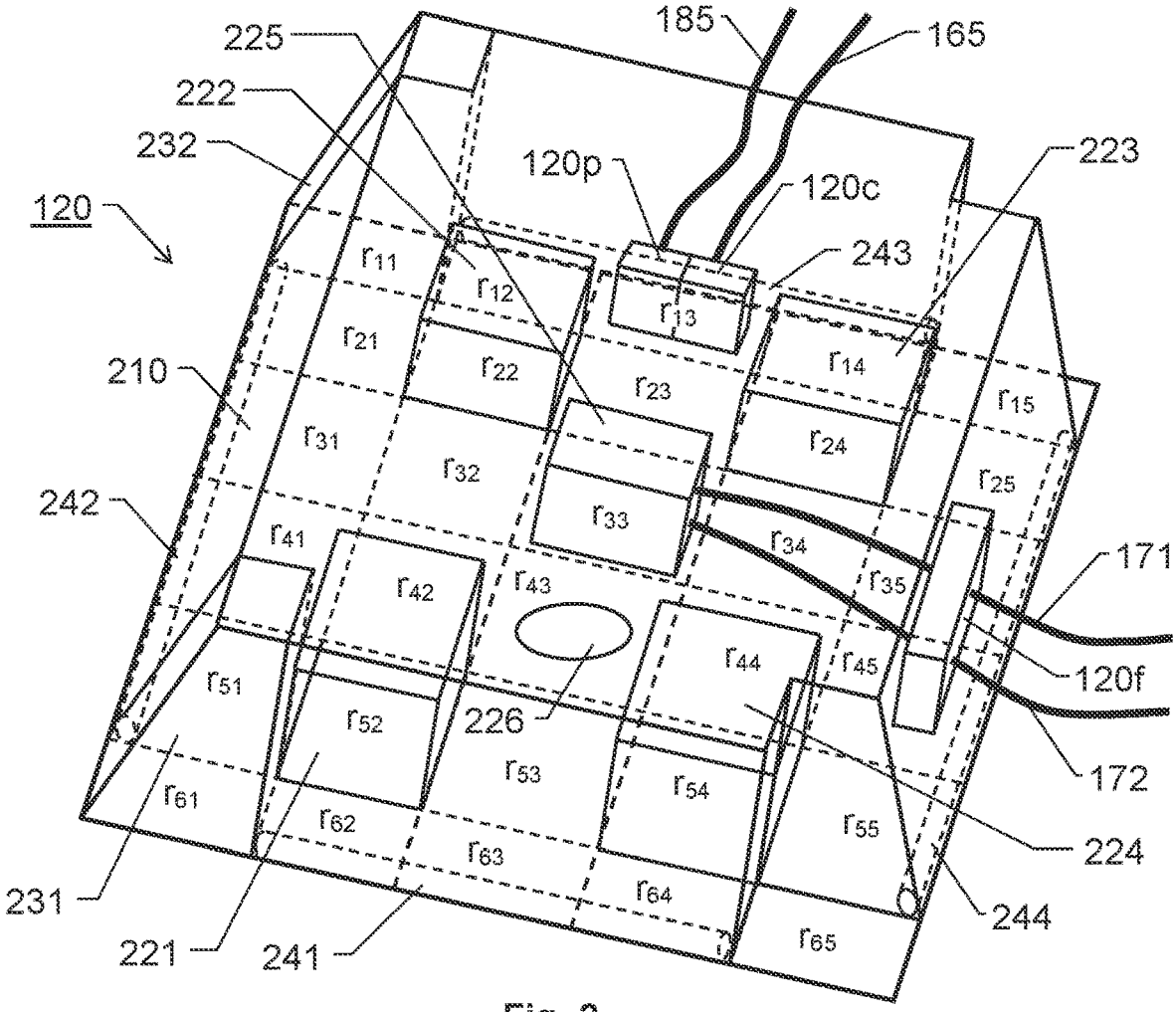
FIG. 2 shows a subsea template according to one embodiment of the invention.

FIG. 2 shows the subsea template 120 for injecting fluid for long term storage in the subterranean void 150 according to one embodiment of the invention. The subsea template 120 contains a base structure 210, a number of utility modules 221, 222, 223, 224, 225, 226, 231 and 232 respectively and a pipe interface 120*f*.

The base structure 210 has a set of module receiving sections $r_{11}$, $r_{12}$, $r_{13}$, $r_{14}$, $r_{15}$, $r_{21}$, $r_{22}$, $r_{23}$, $r_{24}$, $r_{25}$, $r_{31}$, $r_{32}$, $r_{33}$, $r_{34}$, $r_{35}$, $r_{41}$, $r_{42}$, $r_{43}$, $r_{44}$, $r_{45}$, $r_{51}$, $r_{52}$, $r_{53}$, $r_{54}$, $r_{55}$, $r_{61}$, $r_{62}$, $r_{63}$, $r_{64}$ and $r_{65}$ each of which is configured to receive a respective utility module.

Primarily, the utility modules are configured to support the injection of the fluid into the subterranean void 150. The number of utility modules 221, 222, 223, 224, 225, 226, 231 and 232 respectively are installed on the base structure 210, and each of the utility modules is arranged in a respective one of the module receiving sections, here $r_{52}$, $r_{22}$, $r_{24}$, $r_{33}$, $r_{43}$, $r_{54}$, $r_{61}$, and $r_{11}$ respectively.

According to one embodiment of the invention, however, the subsea template 120 exclusively contains a single utility module 226, which is installed on the base structure 210. This single utility module 226 includes a wellhead seal configured to keep the drill hole 140 closed pending for potential future use of the subterranean void 150. The wellhead seal, in turn, may include a battery configured to provide electric power for a minimal set of equipment, e.g. an environmental monitoring device, and/or an actuator for opening and closing a valve element securing the well. Alternatively, or additionally, the battery may power surveillance equipment for monitoring pressure in the well, etc.

As mentioned above, the base structure 210 has a set of module receiving sections that are prepared for receiving various utility equipment, which are needed to operate the full well system if and when it is decided that the subsea template 120 and the subterranean void 150 shall be used for fluid injection, such as $CO_2$. Up until this activation point in time, the base structure 210 preferably only contains the single utility module 226. This arrangement is referred to as a keeper well. The well completion is not installed until it is decided that the site is to be used as a fluid injection well.

The remaining parts of the subsea template 120 structure equipment is installed first when needed. Said structure equipment is preferably adapted to be over trawlable to minimize the risk that fishing equipment is damaged. The remaining parts of the subsea template 120 structure equipment may encompass any required utility modules including associated infrastructure, such as a $CO_2$ pipeline or a direct $CO_2$ injection system from a $CO_2$ carrier vessel, and a power and communications cable from a remote site to the template location. When the remaining parts of the subsea template 120 structure equipment have been installed, the keeper well has been upgraded to a fully functioning injection site. Thus, the subsea template can be kept dormant until a later point in time when it may be conveniently activated.

The pipe interface 120*f* is arranged in the module receiving sections $r_{35}$ and $r_{45}$, and is configured to receive at least one conduit 171 and 172 that transport the fluid to be injected, for instance from the vessel 110 as shown in FIG. 1. Thus, the pipe interface 120*f* is further configured forward the fluid for injection into the subterranean void 150 via the drill hole 140 located under the base structure 210. The pipe interface 120*f* may receive the at least one conduit 171 and 172 respectively from at least one of a fluid store located on a seabed, a pipeline from an onshore facility and/or a vessel 110.

Preferably, the subsea template 120 also has a power interface 120*p* configured receive electric power $P_E$ for distribution to at least one unit in the subsea template 120, typically represented by the utility modules 221, 222, 223, 224, 225, 226, 231 and 232.

In order to enable remote control from the control site 160, the subsea template 120 may contain a communication interface 120*c* that is communicatively connected to the control site 160. According to one embodiment of the invention, the communication interface 120*c* is implemented in one of the utility modules. The communication interface 120*c* is also configured to receive the control commands $C_{cmd}$ via the communication interface 120*c*, and return status signals $s_{stat}$ to the control site 160.

Depending on the channel(s) used for forwarding the control commands $C_{cmd}$ between the control site 160 and the offshore injection site 100, the communication interface 120*c* may be configured to receive the control commands $C_{cmd}$ via a submerged fiber-optic and/or copper cable 165, a terrestrial radio link (not shown) and/or a satellite link (not shown). In the latter two cases, the communication interface 120*c* includes at least one antenna arranged above the water surface 111.

For safety reasons, it is further advantageous if the subsea template 120 contains a monitoring system configured to detect movements in the seabed 130 and/or the subterranean void 150, which movements result from seismic activity. The seismic monitoring system may include sensors arranged to acquire three-dimensional (3D) data at different times over a particular area/10 volume around the subsea template 120 to assess changes in the seabed 130 and/or the subterranean void 150 over time. Said changes may be registered in fluid location and/or saturation, pressure and/or temperature. The sensors may be connected to the subsea template 120 via wired lines or wireless links, e.g. using light-based WiFi, so-called LiFi, technology. Alternatively, or additionally, the seismic monitoring system may be configured to register four-dimensional (4D) seismic data, i.e. timelapse seismic 3D data. Preferably, the 4D seismic monitoring system is specifically configured to monitor movements of the fluids, e.g. $CO_2$ and water, in the subterranean void 150 to verify that the fluids behave as predicted. The 4D seismic monitoring system is further preferably arranged to ensure that any other conditions for storing $CO_2$ in the subterranean void 150 remain within anticipated ranges. The 4D seismic monitoring system may contain receiver devices on the seabed 130, which receiver devices are configured to detect seismic reflections from the subterranean void 150. The 4D seismic monitoring system may also contain a seismic source located on or below the surface of sea, which seismic source is configured to emit a strong hydrophonic signal that is reflected back from the subsurface to the receiver devices on the seabed 130. Based on the received signals, the 4D seismic monitoring system may derive a seismic signature of the injection site 100.

An important aspect of including the seismic monitoring system in the subsea template 120 on the seabed 130 is that said system can thereby be operated by an ROV. Moreover, the modular design of the subsea template 120 according to the invention renders it possible to gradually upgrade and develop the seismic monitoring system over time in an straightforward and cost-efficient manner.

The seismic monitoring system is configured to transmit status signals $s_{stat}$ via the communication interface 120*c*, which status signals $s_{stat}$ indicate whether seismic activity has been detected. Thereby, for example the control site 160 can be adequately notified about any oncoming earthquakes or seismic rumblings that might cause fluid leakage from the injection site 100.

The utility modules 221, 222, 223, 224, 225, 226, 231 and 232, in turn, may contain at least one valve tree 225 which is configured to forward the received fluid to the drill hole 140. Preferably, the at least one valve tree 225 is configured to be remote controllable in response to the commands $C_{cmd}$ received via the communication interface 120*c*.

The utility modules 221, 222, 223, 224, 225, 226, 231 and 232 may further contain a hydraulic pressure tank configured to hold hydraulic fluid to be used by at least one unit in the subsea template 120, an HPU configured to pressurize the hydraulic fluid in the hydraulic pressure tank, an anti-freeze unit configured to store at least one anti-freeze chemical and cause the at least one anti-freeze chemical to be distributed to at least one unit in the subsea template 120, a pump unit configured to pump the received fluid into the subterranean void 150, and/or a battery configured to store electric power and cause the electric power $P_E$ to be distributed to at least one unit in the subsea template 120. Preferably, the power interface 120*p* is configured to distribute the received electric power $P_E$ to the at least one battery.

If at least one HPU is included one or more of the utility modules 221, 222, 223, 224, 225, 226, 231 and 232, the power interface 120*p* is preferably configured to distribute the received electric power $P_E$ to the at least one hydraulic power unit. Moreover, if at least one battery is included, the least one HPU may likewise be powered by the at least one battery, either as an alternative or in addition to the electric power $P_E$ received via the power interface 120*p*.

As mentioned above, the subsea template 120 preferably contains a communication interface 120*c*, which is configured to receive commands $C_{cmd}$ for controlling at least one unit in the subsea template 120 from a control site 160, for instance at an onshore location and/or at the vessel 110. The communication interface 120*c* is also configured to transmit status signals $s_{stat}$ indicating at least one condition of at least one unit in the subsea template 120. The status signals $s_{stat}$ may be sent to the control site 160 to verify that a command has been effected or to specify a current state of at least one of the utility modules 221, 222, 223, 224, 225, 226, 231 and/or 232.

Preferably, the subsea template 120 contains at least one cable channel 241, 242, 243 and/or 244, which may run along the sides of the base structure 210 as shown in FIG. 2. The at least one cable channel 241, 242, 243 and/or 244 is configured to interconnect at least two module receiving sections in the set of module receiving sections, for example the corner module receiving sections $r_{11}$, $r_{15}$, $r_{61}$ and $r_{66}$ in a pairwise manner.

Each of the at least one cable channel is configured to provide exchange at least one of: pressurized hydraulic fluid, electric energy, commands and/or status signals between utility modules 231, 232, 233 and/or 234 installed in the respective at least two module receiving sections $r_{11}$, $r_{15}$, $r_{61}$ and $r_{66}$, respectively. The cable channels 241, 242, 243 and/or 244 are installed in the base structure 210 prior to installing the utility modules 231, 232, 233, and/or 234 in the at least two module receiver sections $r_{11}$, $r_{15}$, $r_{61}$ and $r_{66}$ respectively. Namely, this provides a high degree of flexibility and renders installation of the subsea template 120 very efficient.

Figure 3:
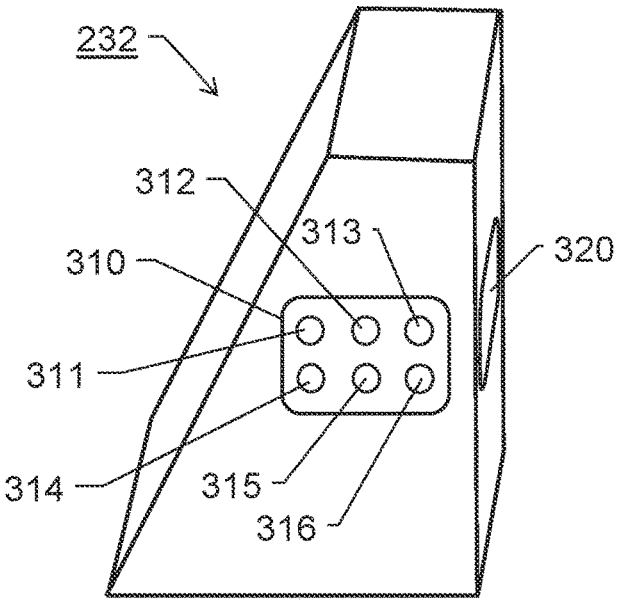
FIGS. 3-5 illustrate corner utility modules of the subsea template according to different embodiments of the invention.

FIG. 3 shows a utility module according to one embodiment of the invention, which is exemplified by the corner utility module 232. The corner utility module 232 contains at least one interface panel 310 and 320 that is configured to enable at least one connection between the corner utility module itself and at least one other utility module in the subsea template 120.

The interface panel, here exemplified by 310, may contain one or more connections for high-pressure hydraulic fluid, e.g. 311, one or more connections for low-pressure hydraulic fluid, e.g. 312, one or more connections for electric communication, e.g. 313, one or more connections for optic communication, e.g. 314, one or more connections for chemicals, e.g. 315 and 316, such as mono ethylene glycol (MEG), di ethylene glycol (DEG) and/or tri ethylene glycol (TEG).

Figure 7:
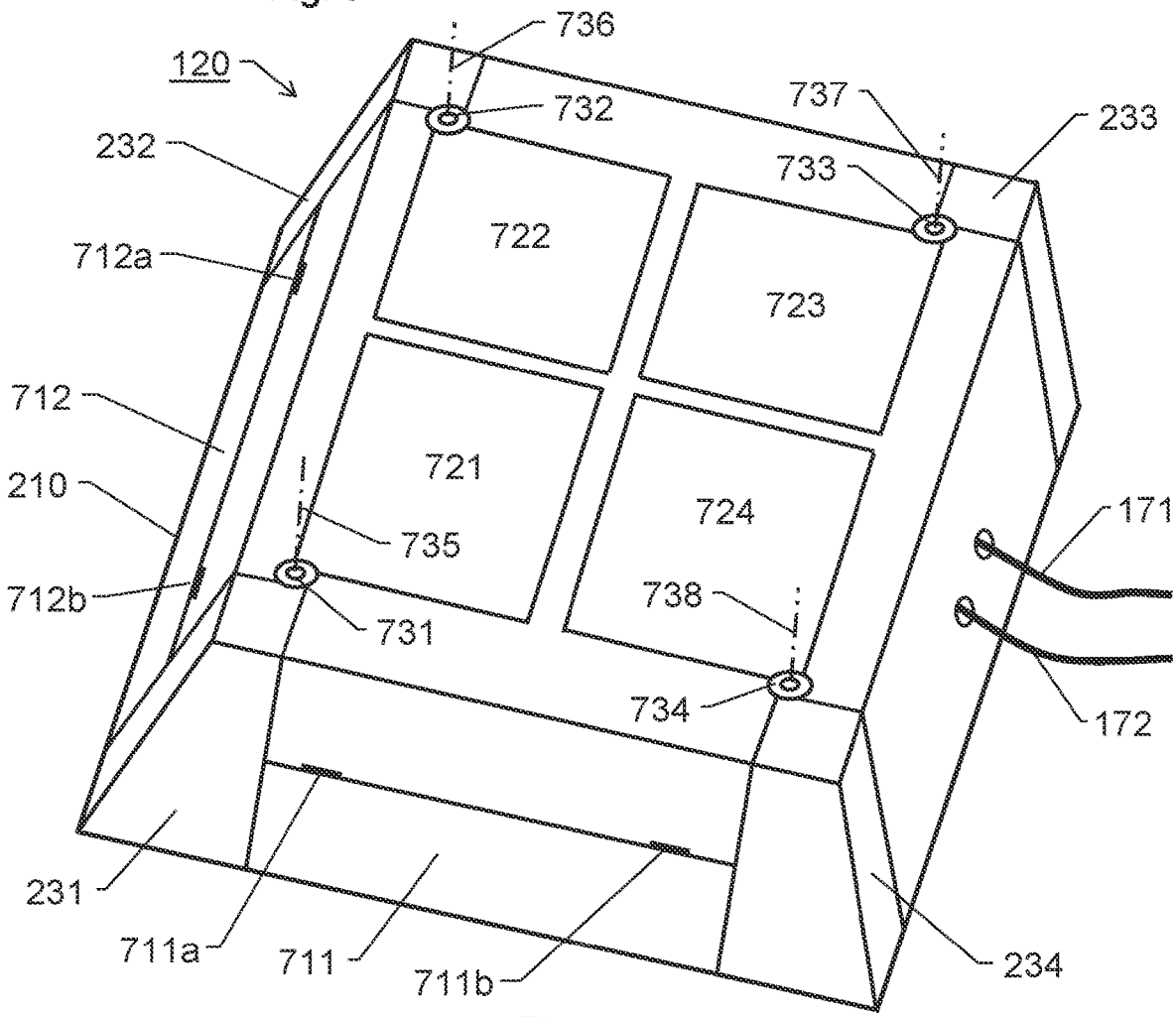
FIG. 7 illustrates different cover arrangements for the subsea template according to embodiments of the invention.

Referring now to FIG. 7, we see an illustration of different cover arrangements for the subsea template 120 according to embodiments of the invention. The base structure 210 preferably has an overall rectangular outline with four corners. A respective corner module receiving section $r_{11}$, $r_{15}$, $r_{61}$ and $r_{66}$ in the set of module receiving sections is located in each of the four corners of the overall rectangular outline.

Figure 4:
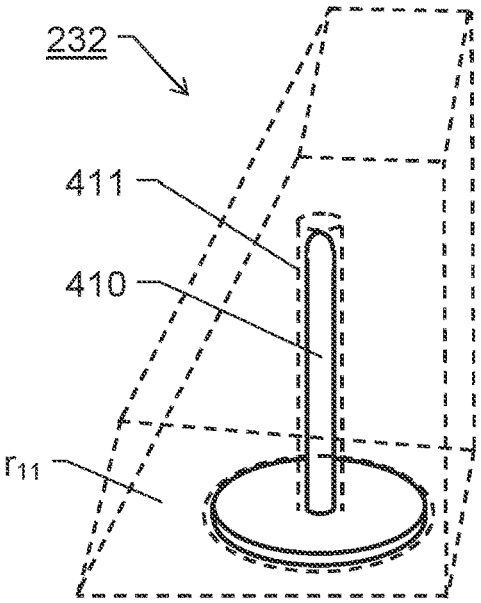

FIG. 4 shows a utility module according to one embodiment of the invention, again exemplified by the corner utility module 232. Each of the corner module receiver sections $r_{11}$, $r_{15}$, $r_{61}$ and $r_{66}$ contains at least one guide member, for example in the form of a rod 410 that is configured to steer the corner utility module 232 towards a final position in the corner module receiving section $r_{11}$ when the corner utility module 232 is lowered over the corner module receiver section $r_{11}$.

Analogously, the corner modules 232 contains at least one receiver member 411 that is configured to engage the at least one guide member 410 so as to cause the corner utility module 232 to be steered towards the final position when the corner module 232 is lowered.

Figure 5:
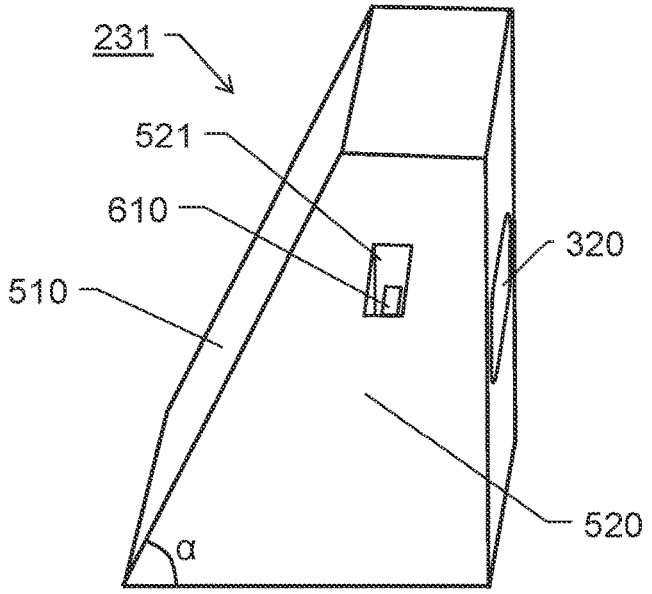

To further facilitate installing the corner modules 231, 232, 233 and 234 as well as other utility modules in the subsea template, lifting lugs may be provided as will be explained below with reference to FIGS. 5 and 6.

According to one embodiment of the invention the corner utility modules, here exemplified by 231, may contain at least one shield surface 510 and/or 520 arranged on an outer side of the corner utility module 231. Each of said outer sides faces away from an interior of the subsea template 120 when the corner utility module 231 is mounted in one of the corner module receiving sections $r_{61}$ on the base structure 210. Moreover, the at least one shield surface 510 and 520 is arranged at an acute angle $\alpha$ relative to an upper surface of the base structure 210. For example, the acute angle $\alpha$ may be in the range 50 to 80 degrees. However, preferably, the acute angle $\alpha$ is 58 degrees because this is stipulated by regulatory requirements in some jurisdictions. The purpose of the shield surfaces 510 and 520 and the acute angle $\alpha$ thereof is to deflect trawling loads from various fishing equipment in an optimal way.

Preferably, at least one of the shield surfaces, here 520, has at least one opening 521 to at least one lifting lug 610. The at least one lifting lug 610, in turn, is configured to enable a lifting hook to be attached thereto for transporting the corner utility module 231 and/or facilitate mounting the corner utility module 231 on the bases structure 210, for example by lowering it as described above.

Figure 6:
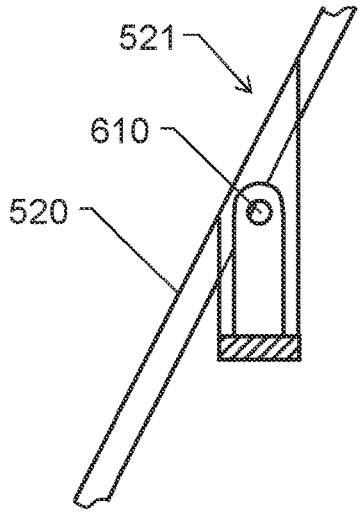
FIG. 6 shows a lifting lug according to one embodiment of the invention.

FIG. 6 illustrates, in a section view, how the at least one lifting lug 610 is recessed in the at least one opening 521. Such a recessed arrangement is advantageous, since it allows trawls to be dragged over the shield surface 520 without risk being entangled in the at least one lifting lug 610.

Referring again to FIG. 7, the subsea template 120 is preferably designed so that the base structure 210 contains an inner area between the corners of the overall rectangular outline of the base structure 210.

Here, at least one top cover element 721, 722, 723 and/or 724 is arranged to close the inner area. The at least one top cover element 721, 722, 723 and/or 724 is attached to a respective one of the corner utility modules 231, 232, 233 and 234 via a respective pivot joint 731, 732, 733 and 734. Each of the pivot joints 731, 732, 733 and 734 has its pivot axis 735, 736, 737 and 738 perpendicular to the base structure 210. Thus, the top cover elements 721, 722, 723 and/or 724 may rotate around its respective pivot axis 735, 736, 737 and 738 essentially parallel to the seabed to open the inner area and provide access to this part of the subsea template 120.

Side cover elements 711 and 712 may be arranged along the sides of base structure 210 between an upper surface of the subsea template 120 and the base structure 210. The side cover elements 711 and 712 are preferably attached via hinges 711*a*/711*b* and 712*a*/712*b* respectively to that allow the side cover elements 711 and 712 to be opened and provide access to the inner area of the subsea template 120.

Variations to the disclosed embodiments can be understood and effected by those skilled in the art in practicing the claimed invention, from a study of the drawings, the disclosure, and the appended claims.

The term "comprises/comprising" when used in this specification is taken to specify the presence of stated features, integers, steps or components. The term does not preclude the presence or addition of one or more additional elements, features, integers, steps or components or groups thereof. The indefinite article "a" or "an" does not exclude a plurality. In the claims, the word "or" is not to be interpreted as an exclusive or (sometimes referred to as "XOR"). On the contrary, expressions such as "A or B" covers all the cases "A and not B", "B and not A" and "A and B", unless otherwise indicated. The mere fact that certain measures are recited in mutually different dependent claims does not indicate that a combination of these measures cannot be used to advantage. Any reference signs in the claims should not be construed as limiting the scope.

It is also to be noted that features from the various embodiments described herein may freely be combined, unless it is explicitly stated that such a combination would be unsuitable.

The invention is not restricted to the described embodiments in the figures, but may be varied freely within the scope of the claims.

The invention claimed is:

1. A subsea template for injecting fluid for long term storage in a subterranean void, the subsea template comprising:

a base structure comprising a set of module receiving sections each of which is configured to receive a respective utility module, a number of utility modules installed on the base structure, wherein each of said utility modules is arranged in a respective one of said module receiving sections, and a pipe interface configured to receive at least one conduit transporting the fluid, which pipe interface is further configured forward the fluid for injection into the subterranean void via a drill hole under the base structure, wherein said utility modules are configured to support the injection of the fluid into the subterranean void;

the base structure has an overall rectangular outline with four corners, and a respective corner module receiving section in the set of module receiving sections is located in each of the four corners of the overall rectangular outline; and each of said corner module receiving section includes a corner utility module comprising at least one shield surface arranged on an outer side of the corner utility module, which outer side faces away from an interior of the subsea template when said corner utility module is mounted in one of said corner module receiving sections on said base structure, the at least one shield surface being arranged at an acute non-zero angle relative to an upper surface of the base structure and being configured to deflect entanglements of said subsea template with objects approaching said subsea template.

2. The subsea template according to claim 1, comprising a power interface configured receive electric power for distribution to at least one unit in the subsea template.

3. The subsea template according to claim 2, wherein at least one battery is comprised in at least one of the utility modules, and the power interface is configured to distribute the received electric power to the at least one battery.

4. The subsea template according to claim 2, wherein at least one hydraulic power unit is comprised in at least one of the utility modules, and the power interface is configured to distribute the received electric power to the at least one hydraulic power unit.

5. The subsea template according to claim 1, wherein said utility modules comprises at least one of:

a hydraulic pressure tank configured to hold hydraulic fluid to be used by at least one unit in the subsea template, a hydraulic power unit configured to pressurize the hydraulic fluid in the hydraulic pressure tank, an anti-freeze unit configured to store at least one anti-freeze chemical and cause the at least one anti-freeze chemical to be distributed to at least one unit in the subsea template, a pump unit configured to pump the received fluid into the subterranean void, and a battery configured to store electric power and cause the electric power to be distributed to at least one unit in the subsea template.

6. The subsea template according to claim 1, wherein each utility module of said utility modules comprises at least one interface panel configured to enable at least one connection between the utility module and at least one other utility module of said utility modules.

7. The subsea template according to claim 1, comprising communication interface configured to:

receive commands for controlling at least one unit in the subsea template, and transmit status signals indicating at least one condition of at least one unit in the subsea template.

8. The subsea template according to claim 7, comprising at least one valve tree which is configured to:

forward the received fluid to the drill hole, and be remote controllable in response to commands received via the communication interface.

9. The subsea template according to claim 1, wherein the pipe interface is configured to receive the at least one conduit transporting the fluid from at least one of:

a fluid store located on a seabed, a pipeline from an onshore facility, and a vessel.

10. The subsea template according to claim 1, wherein:

each of the corner module receiver sections comprises at least one guide member configured to steer a corner utility module of said utility modules towards a final position in the corner module receiving section when the corner utility module is lowered over the corner module receiver section; and each of the corner modules comprises at least one receiver member configured to engage the at least one guide member so as to cause the corner utility module to be steered towards the final position when the corner module is lowered.

11. The subsea template according to claim 1, wherein at least one shield surface of the at least one shield surface comprises at least one opening to at least one lifting lug configured to enable a lifting hook to be attached thereto for transporting the corner utility module, the at least one lifting lug being recessed in the at least one opening to allow trawls to be dragged over the shield surface without risk being entangled in the at least one lifting lug.

12. The subsea template according to claim 10, wherein:

the base structure comprises an inner area between the corners of the overall rectangular outline, and at least one top cover element is arranged to close the inner area, which at least one top cover element is attached to a respective one of said corner utility modules via a respective pivot joint having its pivot axis perpendicular to the base structure.

13. The subsea template according to claim 1, comprising at least one cable channel interconnecting at least two module receiving sections in the set of module receiving sections, which at least one cable channel is:

configured to provide exchange at least one of: pressurized hydraulic fluid, electric energy, commands and status signals between utility modules installed in the respective at least two module receiving sections, and installed in the base structure prior to installing the utility modules in the at least two module receiver sections.

14. The subsea template according to claim 1, wherein the fluid comprises at least 60 wt. % carbon dioxide.

15. The subsea template according to claim 1, wherein exclusively a single utility module is installed on the base structure, which single utility module comprises a wellhead seal configured to keep the drill hole closed pending for potential future use of the subterranean void.

16. The subsea template according to claim 7, further comprising a monitoring system configured to:

detect movements in the seabed and/or the subterranean void, which movements result from seismic activity, and transmit status signals via the communication interface, which status signals indicate whether seismic activity has been detected.

17. A method of operating the subsea template according to claim 1, the method comprising:

controlling a remotely operated vehicle to carry out at least one task to support injection of fluid into the subterranean void via the subsea template, the remotely operated vehicle be stationed on a seabed at the subsea template, or on a vessel, and the remotely operated vehicle being controlled in response to operator commands from at least one of a control site and the vessel.

18. The subsea template according to claim 1, wherein the at least one shield surface is arranged at the acute non-zero angle relative to the upper surface of the base structure in a range of between fifty to eighty degrees.

19. The subsea template according to claim 1, wherein the at least one shield surface includes two shield surfaces, and wherein the two shield surfaces are each arranged on the outer side of said corner utility module facing away from the interior of the subsea template when said corner utility module is mounted in one of said corner module receiving sections on the base structure.

* * * * *